United States Patent [19]

Kimura et al.

[11] 4,019,161

[45] Apr. 19, 1977

[54] TEMPERATURE COMPENSATED DIELECTRIC RESONATOR DEVICE

[75] Inventors: Katsuhiro Kimura, Tokyo; Yoichi Kaneko, Tokorozawa, both of Japan

[73] Assignee: Hitachi, Ltd., Japan

[22] Filed: Sept. 2, 1975

[21] Appl. No.: 609,603

[30] Foreign Application Priority Data

Sept. 2, 1974 Japan ..... 49-99949

[52] U.S. Cl. ..... 333/82 B; 333/82 BT

[51] Int. Cl.[2] ..... H01P 7/04

[58] Field of Search ..... 333/73 R, 73 S, 82 BT, 333/83 T; 331/176

[56] References Cited

UNITED STATES PATENTS 3,798,578 3/1974 Konishi et al. ..... 333/83 T 3,840,828 10/1974 Linn et al. ..... 333/73 S

*Primary Examiner*—Paul L. Gensler

*Attorney, Agent, or Firm*—Craig & Antonelli

[57] ABSTRACT

A temperature compensated dielectric resonator device is composed of a dielectric resonator element mounted on a micro-integrated circuit (MIC) plane. A screw is provided for manually regulating the frequency of the device and a supporting member supporting the screw is disposed in vicinity of the element.

The supporting member dimensions and materials are predetermined, so that the screw may be held at such a position that it compensates for a resonant frequency shift caused by thermal expansion.

3 Claims, 8 Drawing Figures

TEMPERATURE COMPENSATED DIELECTRIC RESONATOR DEVICE

BACKGROUND OF THE INVENTION

1. Field of the Invention

This invention relates to a dielectric resonator device and, in particular, to a construction for temperature compensation of a dielectric resonator device.

2. Description of the Prior Art

Recently, the development of dielectric materials has advanced so remarkably, that it has been possible to obtain dielectric materials having a small loss angle or tan δ and for which the temperature characteristic of the dielectric constant can be controlled in either the positive or negative direction. Also, the use of dielectric materials as resonators having simple construction has been investigated.

The principles of dielectric resonators have long been known in this field, as described for example, in "PROCEEDINGS OF THE IRE", Oct., 1962, page 2081-2092. The Dieletric Microwave Resonator by A. OKAYA and L. F. BARASH".

A dielectric resonator can be made from a piece of dielectric material having a cylindrical or rectangular solid shape. The resonant frequency thereof is determined by the dielectric constant, the dimensions and the shape of the resonator.

In comparison with metal cavities which have been used as microwave resonators, a dielectric resonator has many advantages such as its miniature size, low loss, insensitivity to magnetic DC biasing fields and its ability to concentrate large RF magnetic fields in small volumes.

However, a dielectric resonator has a few disadvantages such as the changeability of the resonant frequency due to the temperature dependency of the dieletric constant, and the difficulty of economically manufacturing a large number of uniform dielectric pieces, Accordingly, it is necessary to compensate for the resonant frequency variation or shift due to variations in temperature.

There are a few known methods of compensating for the resonant frequency variation due to temperature, one of which provides a heat sink near the dielectric resonator element, another of which comprises an element having a small thermal coefficient made from different kinds of dielectric materials.

However, these conventional methods are not always practical from a viewpoint of economy, simplicity or accuracy of the device.

SUMMARY OF THE INVENTION

One object of this invention is to provide a frequency stabilized dielectric resonator device without reducing the advantages of the conventional dielectric resonator.

Another object of this invention is to provide a frequency stabilized dielectric resonator device suitable for micro-integrated circuits (MIC).

Still another object of this invention is to provide an economical and simple dielectric resonator device not affected by temperature variation.

In order to accomplish the above objects, a frequency stabilized dielectric resonator device made in accordance with this invention is composed of a dielectric resonator element, that is, a piece of dielectric material having a predetermined dielectric constant in the shape of a circular, cylindrical, or a rectangular solid, which is mounted on one surface of an MIC substrate, a frequency regulating member manually controlling the resonant frequency of the dielectric resonator device, and a supporting member, one end of which supports the regulating member, the materials which is fixed on the MIC substrate and another end of and dimensions of the supporting member maintaining the resonant frequency of the dielectric resonator device constant regardless of temperature variations.

The above-mentioned and other features and objects of this invention will become more apparent by reference to the following description in conjuction with the accompanying drawings.

DETAILED DESCRIPTION

Figure 1A:
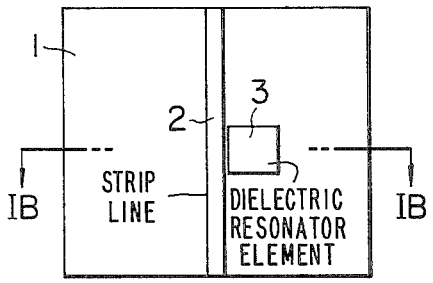
FIG. 1A PRIOR ART
FIG. 1A is a plane view of a conventional dielectric resonator.
Figure 1B:
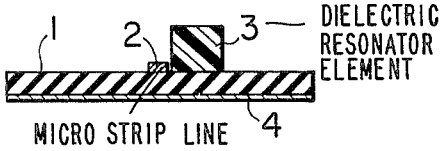
FIG. 1B PRIOR ART
FIG. 1B is a cross-sectional view taken along line IB—IB in FIG. 1A.

Referring to FIGS. 1A and 1B which show the essential construction of a conventional dielectric resonator, a piece of dielectric material 3, namely, a dielectric resonator element, is mounted on one surface of an MIC plane 1 and is located near a conductive strip line 2, also mounted on the MIC plane 1.

The operation of the dielectric resonator is well known, for example as described in the publication mentioned above, so an explanation thereof will be omitted for brevity.

As described above, this type of resonator has many advantages for use as a microwave resonator, but it has the disadvantage of being very sensitive to temperature.

Figure 2:
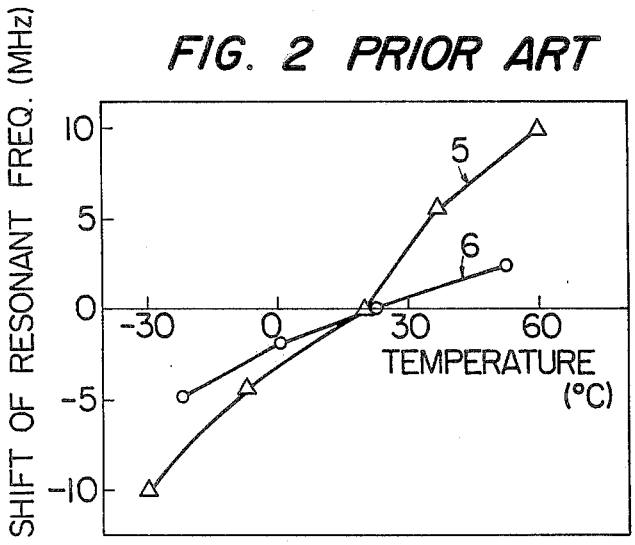
FIG. 2 PRIOR ART
FIG. 2 is a diagram showing the temperature characteristics of the resonator shown in FIGS. 1A and 1B.

In FIG. 2, there are shown two examples of the resonant frequency vs. temperature characteristic of the dielectric resonator shown in FIS. 1A and 1B. In FIG. 2, the abscissa is designated in degrees Celsius, and the ordinate designates the shift of resonant frequency about a temperature of 20° C.

The two plotted lines 5 and 6 show the shift in resonant frequency at a temperature of 20° C of two conventional dielectric resonators. As can be seen from FIG. 2, both resonant frequency vs. temperature dielectric resonators have positive temperature coefficients, i.e. the resonant frequency increases with an increase in temperature.

As the temperature coefficient is determined by the coefficient of the dielectric constant and the thermal expansion coefficient of the dielectric materials, a dielectric resonator having a negative frequency-temperature coefficient can also be formed by the selection of the dielectric material.

However, in practice, it is rather difficult to make dielectric resonator elements having uniform characteristics by conventional dielectric material manufacturing methods.

The lowest temperature coefficient (or the change of coefficient in resonant frequency per degree °C) of the dielectric resonator that can be obtained in the conventional resonator is about $3\times10^{-6}$/° C and it has been difficult to improve the temperature coefficient of the resonator by the selection of the dielectric material.

This invention has solved the above problems by providing a simple frequency compensating mechanism.

Figure 3:
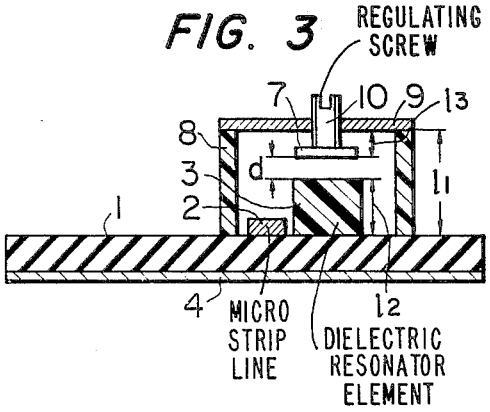
FIGS. 3 and 6 are cross-sectional views of embodiments in accordance with this invention.

FIG. 3 shows a side sectional view of one embodiment of the invention. In FIG. 3, the construction of a dielectric resonator containing an MIC plate 1, a strip line 2 and a dielectric element 3 are substantially the same as the construction shown in FIGS. 1A and 1B, and, in more detail, the MIC plate 1 is made from an alumina ($Al_2O_3$) plate 1 with a thin layer 4 of gold (Au) coated on the back surface.

On the other surface of the alumina plate 1, there are mounted a conductive strip line 2 and a dielectric resonator element 3.

The dielectric resonator element is made of ceramic material comprising $TiO_2$ which has a small dielectric loss or tan δ and has a rectangular solid shape.

This embodiment further comprises a screw 10 regulating the resonant frequency, on one inner end of which a small metallic disc 7 is mounted, and a supporting member having two parts 9 and 8 which support the screw 10 in vicinity of one upper surface of the dielectric element 3.

The dimensions and materials of the supporting member are determined so that the resonant frequency of the dielectric resonator device does not change with temperature variations, as will be discussed below.

In the embodiment shown in FIG. 3, one part 9 of the supporting member is made from an aluminum disc and the other part 8 is made from a Teflon pipe, one end of the part 8 being fixed on one surface of the MIC plate 1 and the other end of the part 8 supporting another part 9 of the supporting member.

Figure 4:
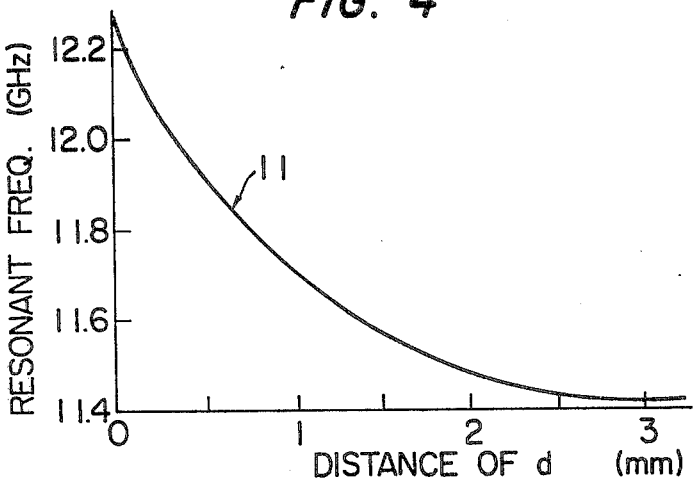
FIG. 4 is a diagram showing the resonant frequency variation of the dielectric resonant device in FIG. 3 due to the variation of distance d.

In the construction, by manually changing the distance d between the disc 7 and one surface of the dielectric element 3 by the use of the screw, without changing the temperature around the element 3, the resonant frequency of the embodiment is changed as shown in FIG. 4.

Accordingly, in the embodiment shown in FIG. 3, the material and dimensions are determined so that the change in the resonant frequency of the dielectric resonator device due to temperature variation can be compensated for by automatically changing the relative distance *d* between the disc 7 and the upper surface of the dielectric element 3 on the basis of thermal expansion.

In more detail, since the resonant frequency *f* of the dielectric resonator is determined by the quality and the dimension of the dielectric element 3, and the relative distance *d* and the frequency *f* are dependent on the temperature, in order to automatically keep the resonant frequency of the dielectric resonator device constant and independent of temperature variations, the material and the dimension of the supporting member 8 are selected and designed so that the frequency shift $\Delta f_d$ of the device due to the change $\Delta d$ in the relative distance depending on the thermal expansion of the supporting member may compensate for the frequency shift $\Delta f_t$ of the dielectric resonator element itself.

For the reason described above, the material and the dimensions of the supporting member of the embodiment shown in FIG. 3 are determined by the following approximate relationships.

$$\Delta d = (l_1\beta_1 - l_2\beta_2 - l_3\beta_3)\,\Delta t$$

where $l_1$, $l_2$ and $l_3$ designate respectively the lengths in the vertical direction perpendicular to the MIC plane, of the supporting member 8, of the dielectric element 3 and of the interior exposed part of the screw 10, and disc 7, $\beta_1$, $\beta_2$ and $\beta_3$ designate respectively the thermal expansion coefficients of the supporting member 8 of the dieletric element 3 and of the screw, and $\Delta t$ designates the thermal variation.

$$\alpha_t = \frac{\Delta f_t}{\Delta t} = \frac{\Delta f_d}{\Delta t} = -\alpha_d\,(l_1\beta_1 - l_2\beta_2 - l_3\beta_3) \qquad (2)$$

where change in the relative distance between the regulating member and the resonator element due to change in $\alpha_t$ is a coefficient of the change in the resonant frequency of the dieletric resonator element itself due to temperature variation and $\alpha_d$ a coefficient of change in resonant frequency of the dielectric resonator device due to the variation in the distance *d*. In other words, $\alpha_t$ and $\alpha_d$ designate the gradients of the plotted lines shown in FIG. 2 and FIG. 4, respectively.

When $l_1\beta_1 >> l_2\beta_2 + l_3\beta_3$, the above formula may be reduced to the following $$\alpha_t = -\alpha_d l_1\beta_1 \qquad (3)$$

Figure 5:
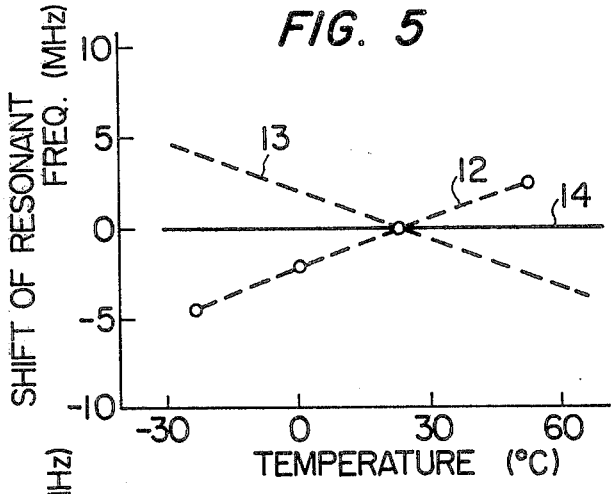
FIGS. 5 and 7 are diagrams showing the resonant frequency vs. temperature characteristics of the resonator devices shown in FIGS. 3 and 6, respectively.

FIG. 5 shows the experimental characteristic of the resonant frequency with temperature variation of the dielectric resonator device in accordance with this invention. In the FIG. 5, the abscissa and the ordinate designate the temperature in degrees Celsius and the frequency shift in $MH_z$, respectively, and the broken line 12 shows the variation of the resonant frequency of the dielectric resonator element itself with temperature, which is substantially equal to the line 6 of FIG. 2, the other broken line 13 shows the variation of the resonant frequency of the dielectric resonator device only with change in the relative distance between the regulating member and the resonator element due to change in temperature and the solid line 14 showns the composite characteristic of the resonant frequency with temperature of the dielectric resonator device. It can be seen that the resonant frequency remains constant in the range from −30° C to +60° C. The dielectric resonant device from which the characteristic shown in FIG. 5 is obtained is designed as follows:

| | |
|---|---|
| Resonating mode | $TE_{111}$ or $TE_{110}$ |
| Desired frequency | 11.65(±0.0035)$GH_z$ |
| Temperature range | −30°C.~60/°C. |
| Dielectric element | |
| material | $T_iO$-$M_aO$-$C_aO$-$L_aO$ |
| dimensions | 5.2mm×5.2mm×5.2mm |
| dielectric coefficient | $\Sigma = 22\ (1-10^{-6}\ \Delta\ t)$ |
| Supporting member | |
| shape | cylindrical pipe |
| vertical length | 1.5 cm |
| inner diameter | 1.47 cm |
| outer diameter | 1.67 cm |
| material | Teflon |
| thermal expansion coefficient | $\beta = 1 \times 10^{-4}$/°C. |

Although the above explanation has described an embodiment using the dielectric resonator element 3 having a positive coefficient ($\alpha_t = \Delta f_t/\Delta t > 0$), this invention is also applicable to the dielectric resonator device using a dielectric resonator element having a negative coefficient ($\alpha_t = \Delta f_t/\Delta t < 0$), as will be described in connection with another embodiment shown in FIG. 6.

Figure 6:
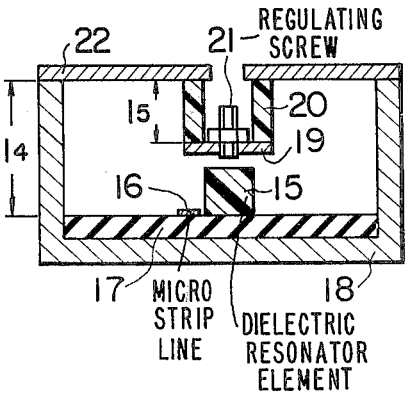

FIG. 6 shows a cross-sectional view of another dielectric resonator device inaccordance with this invention. In this embodiment, the dielectric resonator element 15 having a negative resonant frequency coefficient with temperature is mounted on the surface of an MIC plate which is composed of an alumina plate 17 and one part of an aluminum case 18.

A metallic disc 19, in the center portion of which a frequency regulating screw 21 is provided, is suspended by a supporting member composed of a Teflon circular pipe 20, the upper end of which is mounted on a metallic plate or a lid 22. The material and the dimensions of the supporting member 20 are determined by a following approximate formula (4)

$$\alpha_2 = \begin{matrix} l_4\beta_4 - l_5\beta_5 \\ l_4\beta_4 < l_5\beta_5 \end{matrix} \quad (4)$$

where $\alpha_2$ is the resonant frequency change coefficient of the dielectric resonator element 15, $l_5$ and $l_4$ are resepectively the lengths of supporting member 20 and of the case 18 in vertical direction perpendicular to the MIC plane 117 and $\beta_5$ and $\beta_4$ are respectively the thermal expansion coefficients of the supporting member 20 and of the case material 18.

Figure 7:
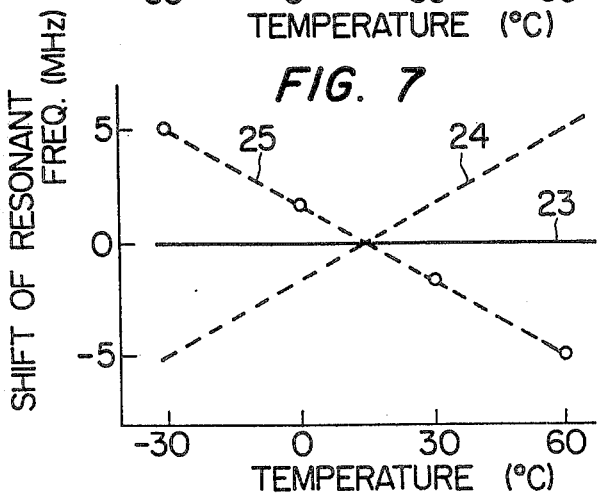

FIG. 7 shows the experimental characteristic of the embodiment shown in FIG. 6, and the broken line 25 represents the resonant frequency change vs. temperature characteristic of the dielectric resonator element 15 itself. The other broken line 24 represents the resonant frequency change vs. the change in relative distance d characteristic for constant temperature, (for the sake of comparison, the relative distance $d$ is represented by the temperature which corresponds to the temperature through which the distance is obtained) and the solid line 23 is the composite resonant frequency characteristic of the dielectric resonator device.

In the two embodiments described above, the resonant frequency of the dielectric resonant element itself is changed on the basis of temperature variation; however, this invention is also effective in cases where a dielectric element insensitive to temperature changes is used, since, even if the dielectric material itself is insensitive to temperature changes, it is very difficult to make a dielectric element having predetermined characteristics. Therefore, it is necessary to provide the frequency regulating member for adjusting the resonant frequency of the dielectric resonator device to the designed frequency. In such a case, the supporting member supporting the regulating member is affected by temperature variations.

Further, it goes without saying that the material and shape of the supporting member are not limited to those described above. There are a number of useful materials for the supporting member, for example, polymer materials having large thermal expansion coefficients such as Teflon, polyethylene, metallic materials having small thermal expansion coefficients such as gold, silver, copper, and other materials having further small thermal expansions coefficient such as quartz. The shape of the supporting member can be replaced by a rectangular parallel pipe, L character type, bridge type, or other types. In summary, the material and shape of the supporting member are selected and designed by taking the resonant frequency, Q value, the temperature of the resonator device, and other circuit arrangements into consideration.

What is claimed is:

1. A dielectric resonator device comprising:
a micro-integrated plane base member;
a dielectric resonator element mounted on said micro-integrated plane base member;
a vertical support member extending vertically from said micro-integrated plane base member;
a frequency regulating screw for manually regulating the resonant frequency of said device, rotatably attached to said vertical support member adjacent said dielectric element; and
a metallic plate, mounted on said screw and having a planar surface facing an upper surface of said dielectric resonator element, the size of the planar surface of said metallic plate being larger than the cross-sectional area of the screw perpendicular to the axis of the screw; and wherein
said vertical support member comprises
a first support member extending vertically from said base member, and
a second support member supported by said first support member above said base member, and wherein
said frequency regulating screw is rotatably attached to said second support member with said metallic plate being affixed to the lower end of said screw, and
said first support member is made from Teflon pipe and said second support member is made from a metallic disc.

2. A dielectric resonator device comprising:
a micro-integrated plane base member;
a dielectric resonator element mounted on said micro-integrated plane base member;
a vertical support member extending vertically from said micro-integrated plane base member;
a frequency regulating screw for manually regulating the resonant frequency of said device, rotatably attached to said vertical support member adjacent said dielectric element; and
a metallic plate, mounted on said screw and having a planar surface facing an upper surface of said dielectric resonator element, the size of the planar surface of said metallic plate being larger than the cross-secitional area of the screw perpendicular to the axis of the screw; and wherein
said vertical support member comprises
a first support member extending vertically from said base member,
a second support member supported by said first support member above said base member, and
a third support member mounted beneath said second support member and above said base member, and wherein
said metallic plate and frequency regulating screw are suspended by said third support member above said dielectric resonator element.

3. A dielectric resonator device according to claim 2, wherein said first support member is formed of a metallic case, said second support member is formed of a metallic plate member and said third support member is composed of a Teflon circular pipe.

* * * * *